United States Patent [19]

French et al.

[11] Patent Number: 5,024,610

[45] Date of Patent: Jun. 18, 1991

[54] LOW PROFILE SPRING CONTACT WITH PROTECTIVE GUARD MEANS

[75] Inventors: Jay L. French, Middletown; John L. Himes, Jr., Hummelstown; Ronald M. Weber, Lebanon; James H. Wise, Palmyra, all of Pa.

[73] Assignee: AMP Incorporated, Harrisburg, Pa.

[21] Appl. No.: 394,602

[22] Filed: Aug. 16, 1989

[51] Int. Cl.[5] ..... H01R 13/00

[52] U.S. Cl. ..... 439/857

[58] Field of Search ..... 439/857, 861, 862

[56] References Cited

U.S. PATENT DOCUMENTS 4,293,890 10/1981 Varsane ..... 439/861

4,598,972 7/1986 Mullen, III et al. ..... 439/861

*Primary Examiner*—Joseph H. McGlynn

*Attorney, Agent, or Firm*—Katherine A. Nelson

[57] ABSTRACT

A self-supporting contact for engaging a conductor combined with guard means for protecting both the contact and the conductor against accidental touch by a human hand. The contact is stamped from a flat strip of resilient, conductive material and has a rectangular body with a plurality, preferably four, spaced along and extending in parallel from one edge of the contact body. Each of the contact fingers is formed with a spring arch located near the end of the finger attached to the contact body. The apices of arches of the fingers are alternately directed above and below the plane of the contact body and the spring arches tension each of the contact fingers so as to bias the free ends of the fingers toward the plane of the contact body. The guard means for the contact comprises an insulating housing enclosing the contact body with portions of each of the contact fingers projecting to the exterior of the housing. The projecting portions of the fingers are enclosed by an insulating silo formed by two opposed shells. Each of the shells are of a corrugated form. One of the shells encloses those ones of the contact fingers having the spring arches directed above the plane of the contact body. The other of the shells encloses those ones of the contact fingers having the spring arches directed below the plane of the contact body. The guard means for the conductor to be engaged by the contact comprises an insulating housing enclosing the conductor. An opening in the conductor housing aligned with the conductor provides access to the conductor by the contact fingers. The opening has an outline which is complimentary to the outline of the periphery of the silo. The contact fingers and the silo are so dimensioned that no gap in the space enclosed by the opening is of sufficient width to permit entry by a human finger and contact of the conductor underlying the opening.

7 Claims, 5 Drawing Sheets

LOW PROFILE SPRING CONTACT WITH PROTECTIVE GUARD MEANS

FIELD OF THE INVENTION

The present invention relates to a spring contact for releasably engaging an electrical conductor to establish a circuit connection thereto. More particularly, it relates to a spring contact having a low profile for enabling a plurality of contacts to be disposed columnarly with reduced spacing therebetween and to protective guard means, both for the contact and the conductor to be engaged thereby, to protect against accidental contact therewith by a human hand.

BACKGROUND OF THE INVENTION

In copending application Ser. No. 07/394,775, filed Aug. 16, 1989, "Power Distribution System for Modular Furniture Units", owned by the assignee of the present invention, a power distribution system is described and claimed which includes a power block having an insulating housing containing ten vertically aligned, parallel bus bars to which circuit connections are established by various plug-in components of the system. The plug-in components may comprise a connector for a jumper cable interconnecting the power distribution systems of adjoining furniture units such as wall panels or a connector through which power is supplied to the furniture or panel distribution system from the base power distribution system or it may comprise an outlet unit containing receptacles for the plugs of power cords attached to electrical appliances.

In the distribution system of the referenced application, the bus bars are flat and closely spaced to reduce the height of the power block, so that the power block can be fit into the space available in furniture units of existing design. The close spacing of the bus bars requires that the male contacts of the plug-in components used with the system be of low profile to enable the contacts to be arranged in a columnar pattern of a height compatible with the height of the power block while still preserving adequate spacing between the adjacent contacts of the column.

One type of prior art contact that can be fashioned with a profile of a height corresponding to the height of the profile of the contacts of the present invention is the single beam cantilever type contact. Such a type of contact requires that the fixed end of the contact beam be rigidly supported in the housing of the contact in order to counter the reaction force developed at that end of the beam when the free end of the beam is deflected. Such a requirement demands that the structure supporting the fixed end of the contact beam be dimensionally stable with time if normal pressure by the contact upon the conductor engaged is to be maintained throughout the life of the contact.

Conventional contact housings are molded from an insulating plastic material. As is well known, objects molded from plastic have a tendency to change dimensionally due to creep of the plastic with age. This tendency is amplified when the object is subjected to continuous forces in an environment of elevated temperature.

SUMMARY OF THE INVENTION

The present invention comprises a low profile contact capable of engaging and exerting continuous contact pressure upon a conductor without dependence upon any contact supporting structure. The contact is mounted in an insulating housing of a plug-in component with a portion of the contact projecting from the component housing for entry into the power block housing. In accordance with the invention, the actual contact points for the line and neutral conductors lie within the power block housing and the contact points for the ground conductors lie within the component housing. The design of the contact 10 is particularly suitable for use in high density connectors. To protect against accidental touching of either the projecting portion of the contact or the conductor of the power block which the contact engages, the invention further comprises a protective insulating silo which shields the exposed contact portion and an opening in the power block housing having a form complimentary to the outline of the insulating silo.

The contact comprises a generally rectangular back beam having four spaced fingers extending in parallel from one edge thereof. The contact is stamped from a relatively thin sheet of resilient conductive alloy. Spring arches are formed in each of the fingers near the ends connected to the back beam. The peaks of the arches project transversely to the plane of the beam in alternately opposite directions along the sequence of fingers. The arches are shaped so that ends of the fingers remote from the beam, except for the tips thereof, lie substantially in the plane of the beam and are biased toward the plane of the beam if deflected therefrom. The tips of the fingers are turned outward from the plane of the beam to facilitate entry between the fingers of a conductor extending along the plane of the beam. The conductor becomes interwoven between the fingers so that successive fingers along the length of the beam lie on opposite sides of the conductor.

The contact fingers project outward from the rear face of the insulating housing in which the contact is installed The fingers are surrounded by an insulating silo molded onto the housing. The outline of the silo conforms to the profile of the fingers, giving the silo a crenellated appearance when the silo is viewed in front elevation. The silo fits into an opening of a housing containing the conductor to be contacted by the fingers. The opening is formed with an outline which is complementary to the outline of the silo surrounding the fingers. The low profile of the fingers permits the outline of the silo to be so dimensioned that none of the gaps in the opening of the housing containing the conductor is sufficiently wide to permit contact of the conductor underlying the opening by a human finger.

It is an object of the invention to provide a contact having a low profile whereby a plurality of contacts may be arranged in a columnar pattern in an electrical connector with close spacing between adjacent contacts.

It is a further object of this invention to provide a low profile contact and guard means therefor that are capable of being used in high density arrays.

It is another object of the invention to provide a contact capable of releasably engaging a conductor and which does not depend upon the application of any reaction force to the contact by the housing in which it is contained in order to develop or maintain contact pressure upon the conductor.

It is still another object of the invention to provide guard means for a contact and for the conductor to be engaged by the contact which will at all times protect against accidental touch of the contact or the conductor by a human hand.

DETAILED DESCRIPTION OF THE PREFERRED EMBODIMENT

Figure 1:
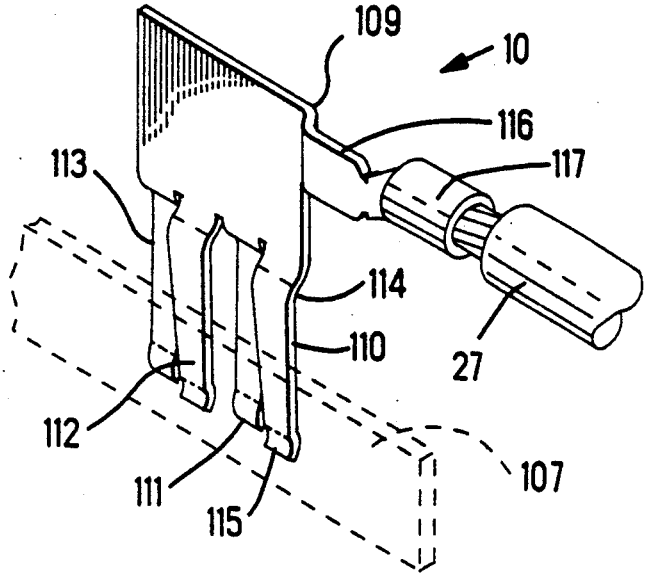
FIG. 1 is an isometric drawing of the contact of the invention.

FIG. 1 is an isometric drawing of the contact 10 of the invention. Contact 10 is fabricated from a strip of resilient conductive alloy of generally rectangular shape before forming. The lower portion of the strip is slit to form four parallel fingers 110–113 depending from a back beam 109. Each of the fingers 110–113 is bent out of the plane of beam 109 to form a spring arches 114 at the base of the fingers which bias the free ends of the fingers back into the plane of beam 109 when the finger ends are displaced therefrom. The directions of the bends of arches 114 alternate from side to side of the plane of beam 109 along the length of the beam. The tips 115 of the free ends of the fingers are bent outward from the plane of beam 109 to facilitate passage of the fingers over the edge of a conductor, preferably in the form of a flat bus bar (shown in phantom at 107), with which contact is to be established. Upon engagement with the bus bar, the fingers 110–113 alternately extend over and exert pressure upon the opposite surfaces of the bus bar, which then becomes threaded through the fingers along the plane of beam 109. The form of construction of the contact 10 is conservative of space and provides the further advantage that the reaction forces of the fingers 110–113 upon beam 109 when the fingers are in engagement with a bus bar generate counterbalancing torques within beam 109. Therefore, upon engagement with a bus bar, the contacts do not exert any reaction force upon the housing in which the contacts are mounted and do not depend upon such reaction forces for the maintenance of contact pressure upon the bus bar. Thus, the contact pressures do not lessen because of minor changes in the housing dimensions resulting from relaxation of the housing.

More specifically, when the fingers are deflected by engagement with the bus bar, the fingers 110–113 apply transverse forces to the beam 109 which are alternately opposite in direction. The resultant of these forces is zero, so the beam is not subjected to any translational force. The moment applied to the beam by the force couple generated by fingers 110 and 113 at the opposite ends of the beam causes an increase in the magnitudes of the forces applied to the beam by the inner pair of fingers 111 and 112. The force couple generated by the inner pair of fingers applies a moment to the beam which exactly counterbalances the moment applied thereto by the force couple of fingers 110 and 113 Thus, beam 109 is subject neither to rotation nor to translation when in engagement with the bus bar and the beam does not exert any reaction force on the housing in which it is contained.

In the embodiment shown beam 109 is formed with a tab 116 projecting laterally from the upper edge of the beam and having a crimp terminal 117 fashioned on the end for attachment of a wire 27. Other terminals and terminating means as known in the art may also be used in place of terminal 117.

Figure 2:
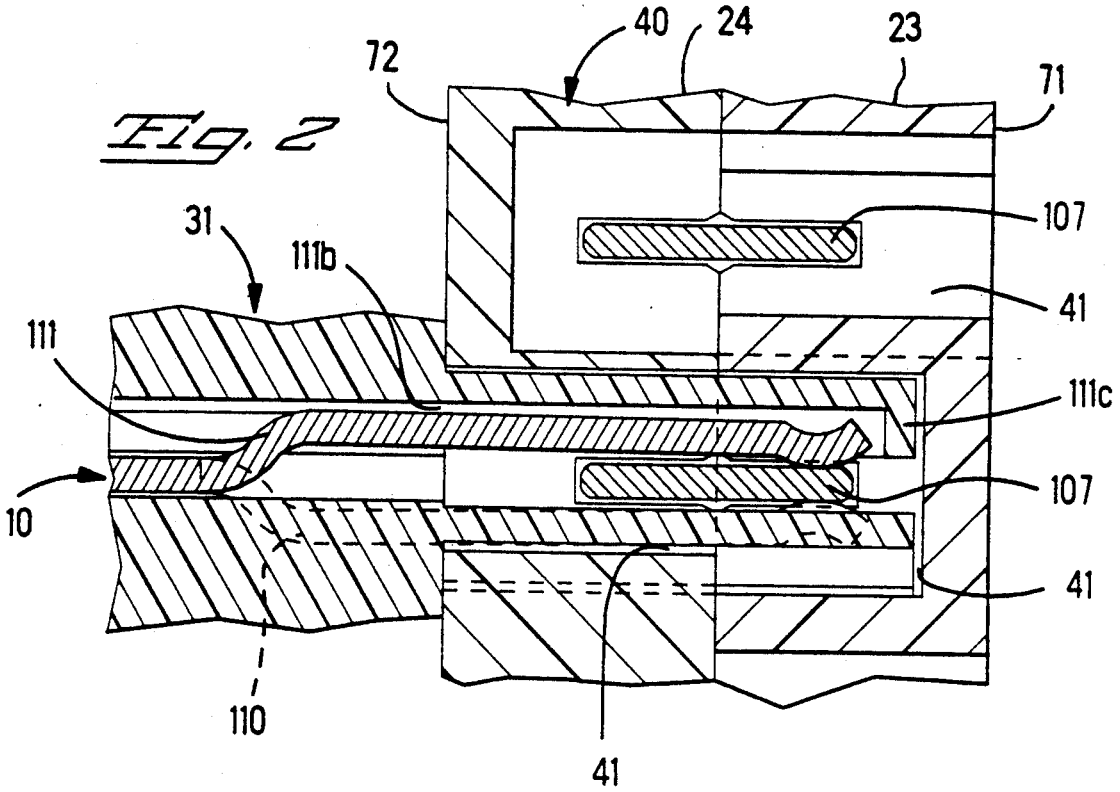
FIG. 2 is a cross-sectional view of the contact of FIG. 1 in a housing having guard means thereof inserted into the housing of FIG. 1A and with the contact mated to the conductor therein.
Figure 3:
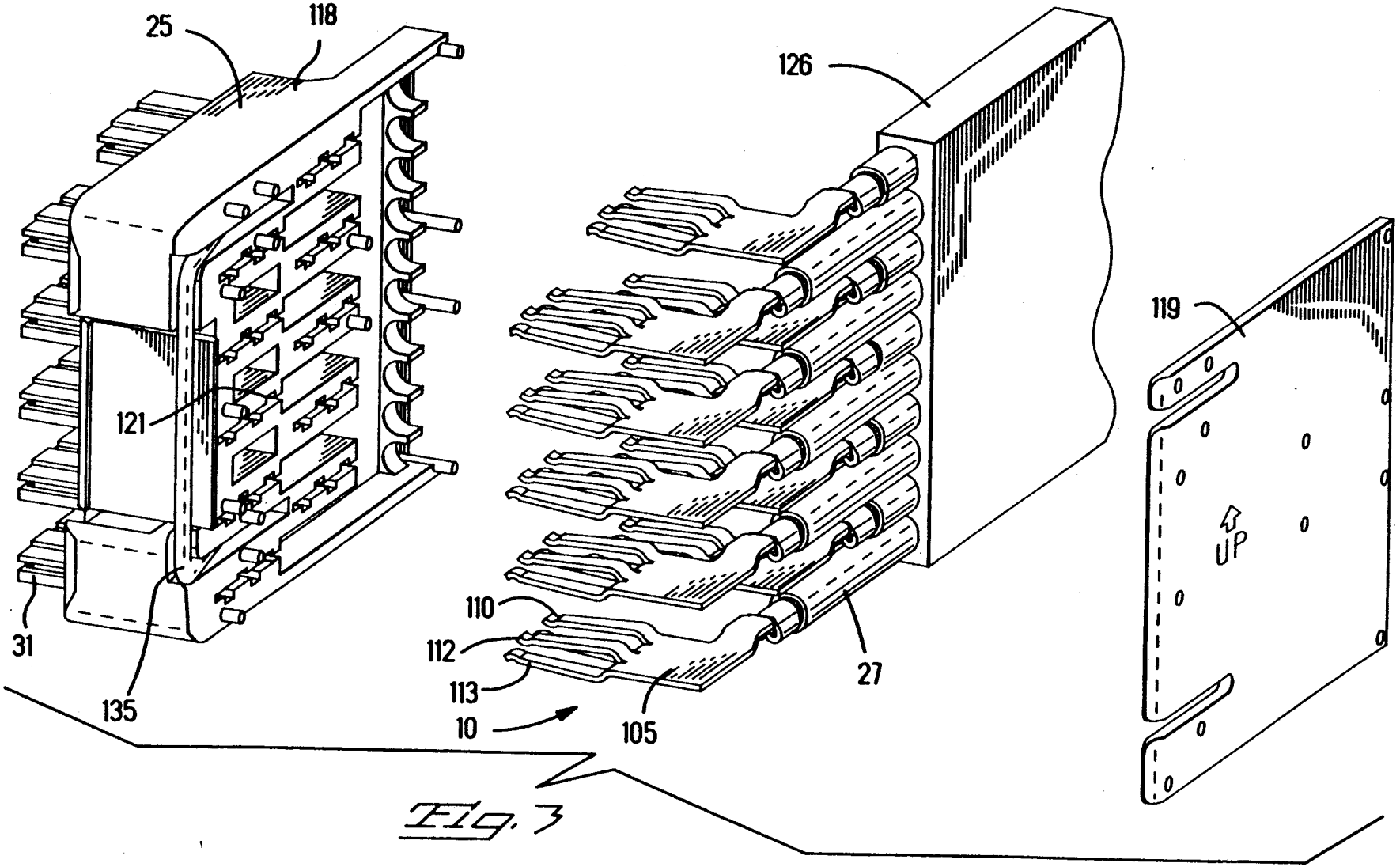
FIG. 3 is an isometric drawing of an exploded view of an electrical connector employing the contacts and guard means of the invention.

Contact 10 is normally installed in an insulating housing, such as housing 118 of connector 15 shown in FIG. 3, with beam 109 residing in the body of the housing and with the fingers 110–113 projecting from the rear face of the housing 118. These contact fingers are surrounded by insulating silos 31 molded onto the rear face of the housing 118. In accordance with the invention, the bus bar or conductor 107 is contained within an insulated housing, shown as 40 in FIGS. 1A and 2, such that the contact points of fingers 110–113 of the contact 10 lie within the conductor housing, as best seen in FIG. 2. Thus, only the housing for contact 10 need be provided with silos to prevent accidental contact either with contact 10 or conductor 107 by human fingers during mating or unmating thereof.

Figure 1A:
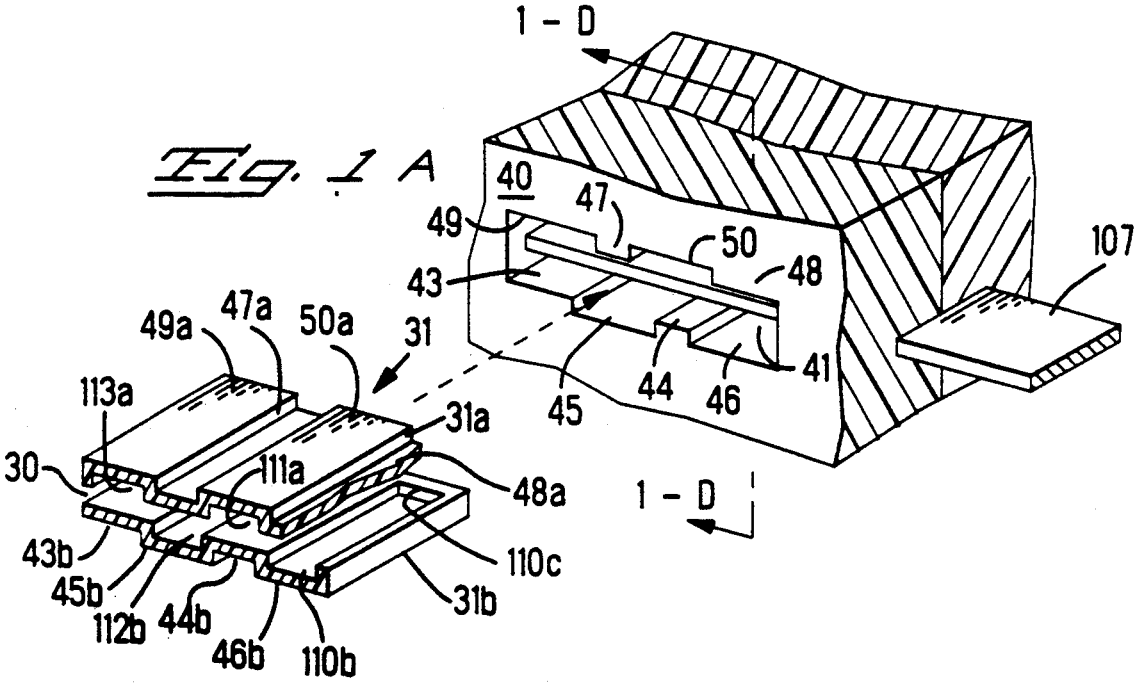
FIG. 1A is a fragmentary perspective view of the guard means of the invention for enclosing portions of the contact shown in FIG. 1, broken away from the housing therefor and exploded from a portion of a housing for the conductor to be engaged by the contact shown in FIG. 1, showing the form of an opening in the housing conforming to the form of the guard means shown in FIG. 1A, the form of the housing opening constituting the guard means of the invention for protecting the conductor against accidental touch.
Figure 1B:
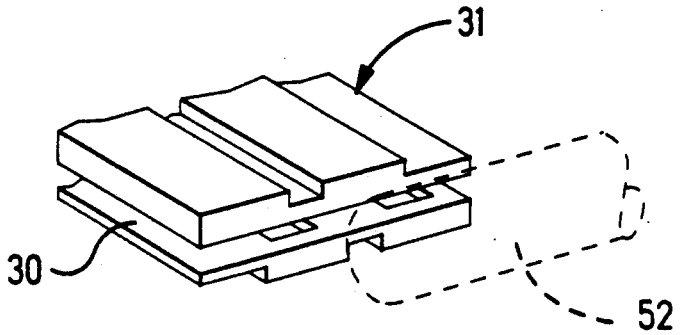
FIG. 1B is a fragmentary perspective view of the guard means for the contact of FIG. 1 demonstrating the protection against accidental touch of the contact fingers contained therein.
Figure 1C:
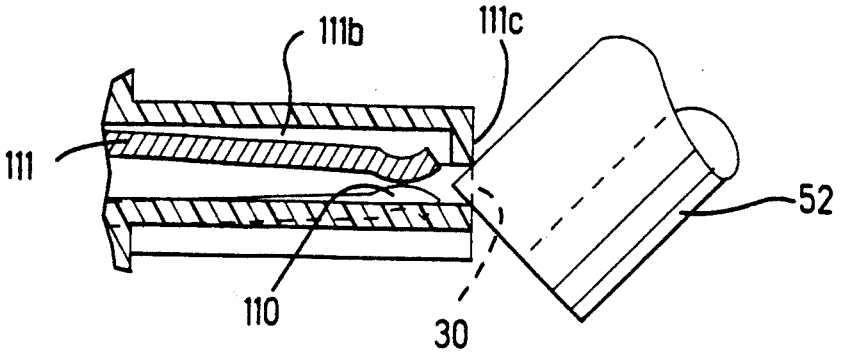
FIG. 1C is a fragmentary cross-sectional view illustrating the guard means for one finger of the contact of FIG. 1 and demonstrating the protection against accidental touch of the contact finger contained therein.

FIG. 1A is a perspective view of an insulated silo 31 broken away at the base from the face of the housing upon which it is molded and exploded from the mating housing 40 containing conductor 107 therein. Silo 31 comprises two opposed shells **31*a* and 31*b* spaced apart to provide a groove 30 of sufficient width to clear the thickness of a bus bar, such as bus bar 107. The walls of shells 31*a* and 31*b* are relatively thin and are convoluted to provide interior channels 110*b*, 111*a*, 112*b* and 113*a* into which the fingers 110–113 extend, respectively, with sufficient clearance to permit deflection of the fingers upon engagement with a bus bar, as best seen in FIG. 2. The ends of such channels are covered by overturned lips shown as 110*c* in FIG. 1A and as 111*c* in FIGS. 1C and 2, and which extend from the outer surfaces of the channels to the edge of groove 30. The contact fingers 110–113 are accessible only through groove 30, which is too narrow to permit entry by a human finger and thus the contact fingers are at all times protected against touch by a human hand or a 0.25 inch diameter test probe 52 as shown in FIGS. 1B and 1C**.

Bus bar 107 is contained in an insulating housing 40 and is accessible to the fingers of contact 10 through an opening 41 in the face of the housing 40. FIG. 1A is a view of a portion of a face of the housing 40 containing bus bar 107 showing the form of the opening 41 through which silo 31, and the contact fingers contained therein, enters the housing 40 to access bus bar 107. Opening 41 is aligned with bus bar 107 and is formed with an outline which is complimentary to the outline of silo 31. The ends of portions 43 and 44 of the lower edge of opening 41 lie in a plane which is sliqhtly below the plane of the lower surface of bus bar 107 to provide clearance for portions **43*b* and 44*b* of silo 31. The plane of portions 45 and 46 of the opening is stepped down from the plane of the ends of portions 43 and 44 to provide clearance for portions 45*b* and 46*b* of silo 31. Preferably the elongated edges of conductor or bus bar 107 are chamfered to facilitate mating of contact 10 therewith. The movement of fingers 110–113 across conductor 107** provides wiping of the corresponding contact surfaces.

The upper edge of opening 41 is also corrugated with the ends of portions 47 and 48 thereof lying in a plane which is slightly above the plane of the upper surface of bus bar 107 to provide clearance for portions **47*a* and 48*a* of silo 31. Portions 49 and 50 of the upper edge lie in a plane which is stepped up from the plane of the ends of portions 47 and 48 to provide clearance for portions 49*a* and 50*a* of silo 31**.

Figure 1D:
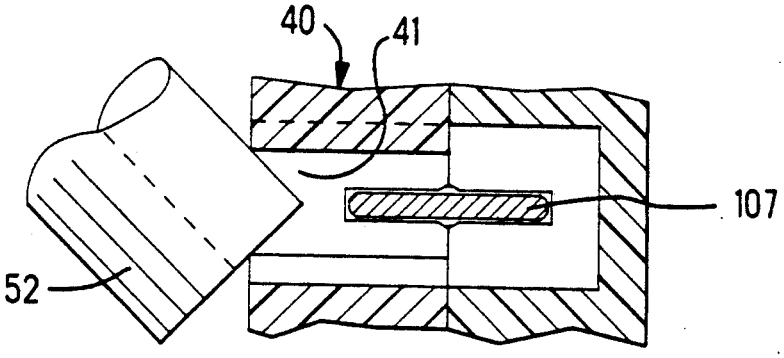
FIG. 1D is a section taken along the line 1D—1D of FIG. 1A demonstrating the protection against accidental touch of the conductor contained by the housing of FIG. 1A afforded by the guard means of the invention.

The opening 41 is so dimensioned that the silo 31 will pass therethrough with close clearance and the silo is so dimensioned as not to require any gaps in the opening 41 of such width as to permit entry from any angle of a 0.25 inch diameter blunt-ended test probe to a depth permitting any part of the probe end to contact the bus bar exposed through the housing opening. FIG. 1D is a cross section of the conductor housing 40 shown in FIG. 1A, taken along the line 1D—1D, and showing a 0.25 inch diameter test probe 52 inserted in opening 41. It is evident that no part of the probe can penetrate the opening 41 deep enough to contact bus bar 107. Therefore, the bus bar is protected at all times against touch by a human finger, whether during installation or removal of a contact enclosed by a silo 31 or when no contact is installed in the opening.

FIG. 2 shows silo 31 having contact 10 therein inserted into opening 41 of housing 40 with spring fingers 110 (in phantom) and 111 of contact 10 electrically engaged with bus bar 107. As can be seen in this view, and FIG. 1C, the respective channels provide sufficient clearance for the respective spring arms to deflect upon engagement with bus bar 107. FIG. 2 further shows a second opening 41 in the opposite face of housing 40 and another bus bar 107 therein.

FIG. 3 is a perspective exploded view of a connector 25 for a jumper cable 126 designed for use in the power distribution system disclosed in the above-referenced application Ser. No. 07/394,775. Connector 25 includes insulated body section 118 and insulated cover plate 119. The interior of housing 118 includes a plurality of slots 121 designed to receive contact member 10. As shown herein housing 118 also includes bail 135 which provides means for securing connector 25 in the system described in the above patent application and in copending patent application Ser. No. 07394,591, filed Aug. 16, 1989 for "Latch and Locking Handle for an Electrical Connector," owned by the assignee of the present invention. FIG. 3 particularly illustrates the close spacing between adjacent contacts 10 arranged in a columnar pattern which is enabled by the low profile of the contact of the invention.

Figure 4:
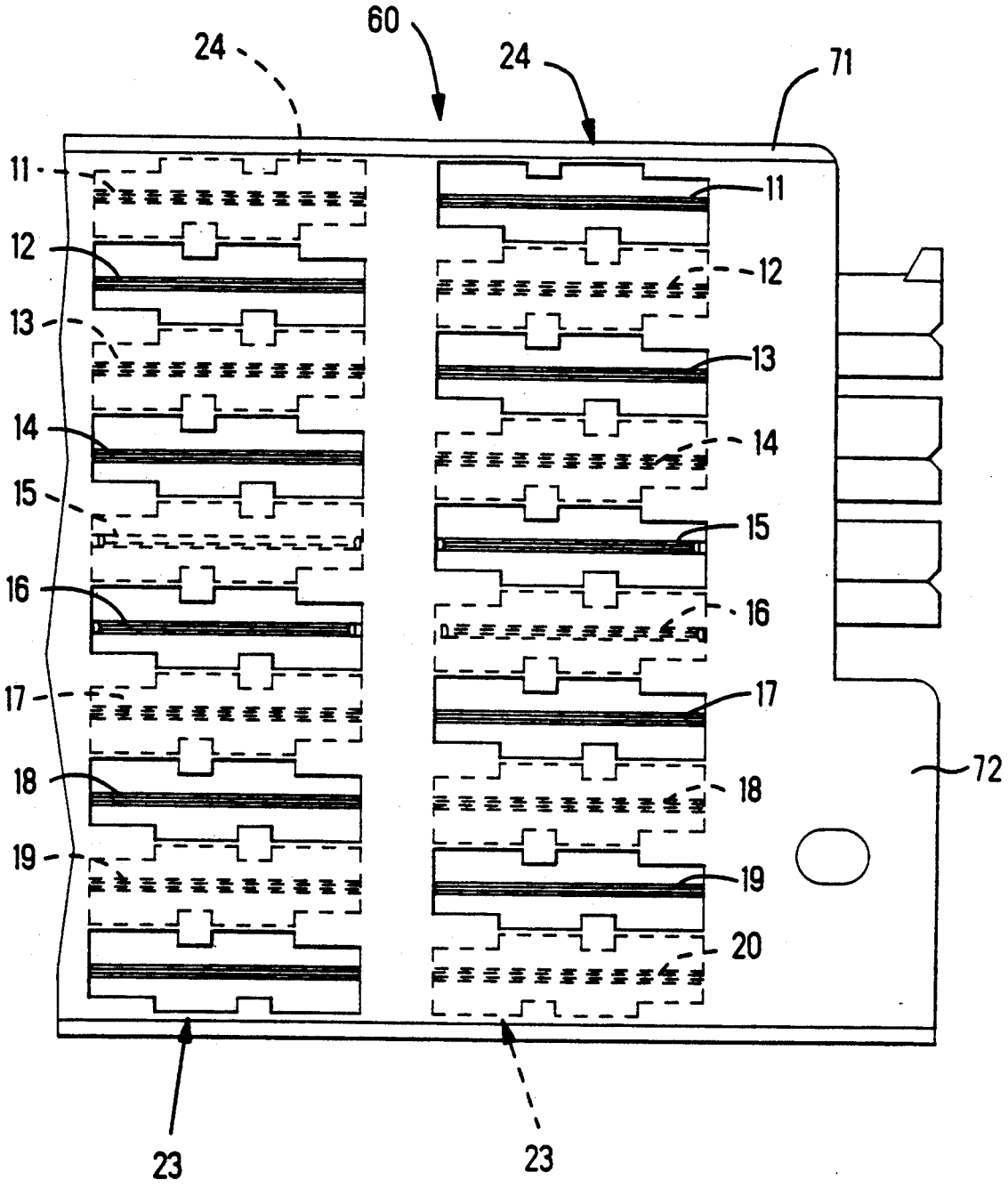
FIG. 4 is a fragmentary isometric view of the portion of a power distribution system illustrating the arrangement of the openings on the forward face thereof for receiving the guard means and contacts of the connector of FIG. 3 and with the openings on the rearward face thereof being in phantom.

FIG. 4 is a fragmentary portion 60 of a power distribution system containing ten, parallel, vertically aligned bus bars 11–20, accessible from both forward and rearward sides 72, 71 respectively of the power block. For purposes of clarity, only those portions of the bus bars accessible through the openings are shown in FIG. 4. The openings and bus bars accessible from rearward face 71 are shown in phantom. The openings illustrated are configured to mate with connector 25 of FIG. 3. As can be seen in FIG. 4, access to bus bars 11–20 in portion 60 is provided by a series of ten openings arranged in two vertically aligned columns 23, 24 of five openings each on both faces of the power block. The openings in each respective column 23, 24 are spaced from the adjacent openings of the same column and are staggered with relation to the openings of the adjacent column. The openings in column 23 thereby provides access to the odd numbered bus bars and the openings in column 24 provide access to the even numbered bus bars. FIG. 4 clearly illustrates the interesting of the openings from the opposite faces of the power block and the high density array achievable with the present invention. As shown in FIG. 2, connector 25 on the left-hand side has been inserted such that its respective silos 31 enter the openings on row 24 in face 72; and likewise 9 similar connector on the right-hand side maybe inserted such that its silos enter the openings in row 23 in face 72. The contacts 10 in respective silos of the two connectors engage respective bus bars 107.

Figure 5:
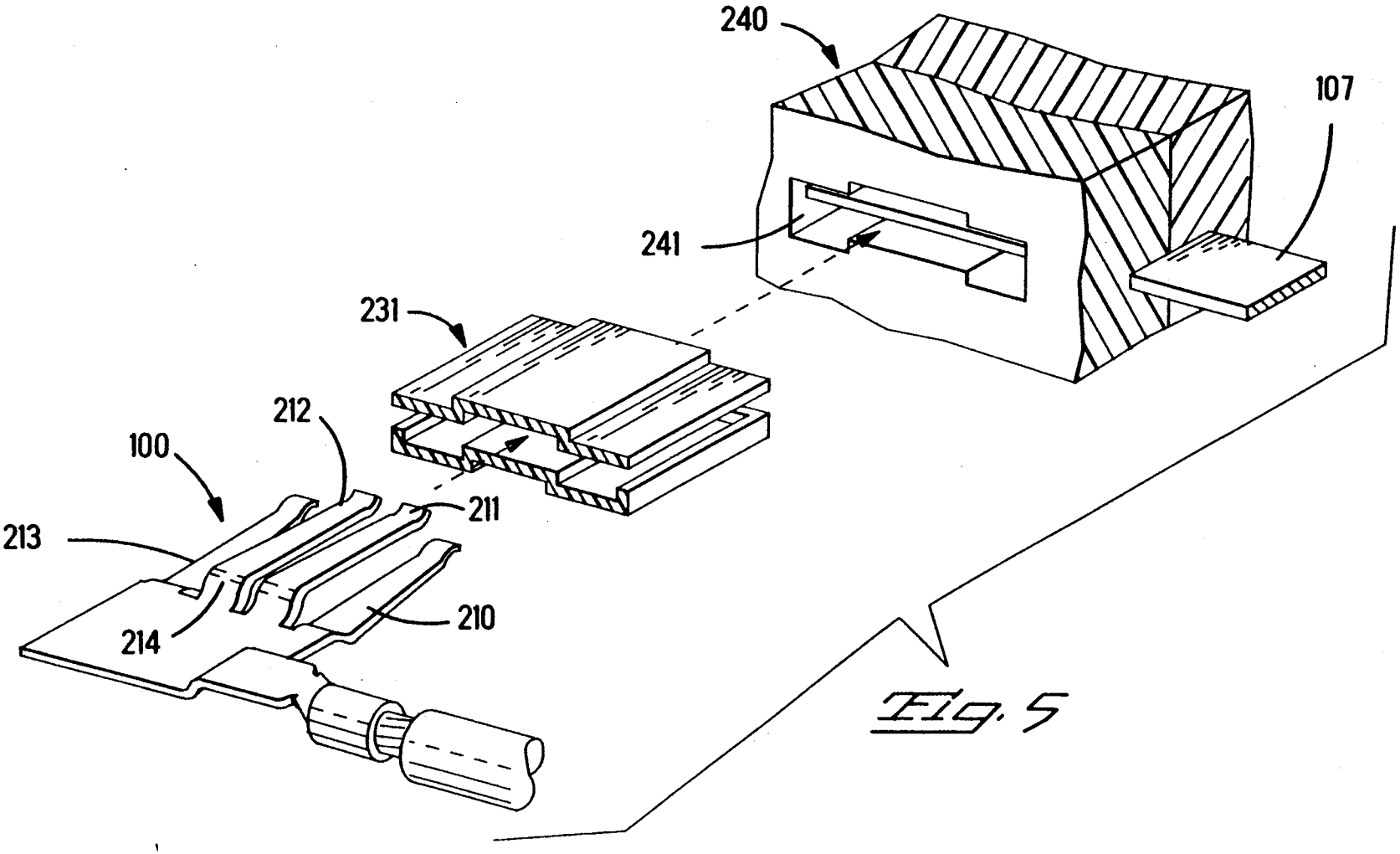
FIG. 5 is an exploded view of an alternative embodiment of the contact and the guard means therefor.

FIG. 5 illustrates an alternative embodiment 100 of the contact wherein the spring arches 214 of the outermost compliant beams 210, 213 face one direction and the spring arches 214 of the innermost beams 211, 212 face the opposite direction. The shape of silo 231 and the corresponding complimentary opening 241 in housing 240 are configured to accommodate the shape of contact 100 and provide similar advantages and safety features as previously described.

Obviously, modifications and variations in the structure of the invention are possible in the light of the above teachings. It is therefore to be understood that the invention may be practiced otherwise than as specifically disclosed without departing from the spirit and scope of the appended claims.

We claim:

1. A contact for releasably engaging a conductor, combined with guard means for protecting said contact and said conductor against accidental touch by a human hand, said contact and said protective means comprising, in combination:

an elongated contact body of resilient conductive material;

a plurality of contact fingers formed integrally with said contact body, said fingers being spaced apart along an edge of said contact body and projecting in parallel from said edge of said body;

a first insulating housing, said first housing enclosing said contact body with at least portions of each of said contact fingers extending through said first housing to the exterior thereof, said extending portions of said fingers being adapted to engage said conductor;

an insulating silo for enclosing said portions of said contact fingers extending to the exterior of said first housing, said silo being formed in first and second sections, one of said sections being positioned above said contact fingers and extending laterally across said plurality of fingers, the other of said sections being positioned below said contact fingers and extending laterally across said plurality of fingers, both of said sections extending longitudinally coextensively with said portions of said contact fingers extending to the exterior of said first housing, both of said sections being corrugated in form and having channels open to the interior of said sections extending longitudinally over alternate ones of said contact fingers, said channels of said second section extending over those alternate ones of said fingers which are interspersed between those alternate ones of said fingers which are covered by said channels of said first section, the interior and exterior walls of said first and second sections extending substantially colinearly with one another so that the exterior surface of said silo is corrugated in form similar to the outline of the space enclosed by the interior walls of said first and second sections;

a second insulating housing, said second housing enclosing said conductor to be engaged by said contact fingers;

an opening in said second housing aligned with said conductor enclosed by said second housing, said opening having an outline which is complimentary to and congruent with the peripheral outline of the exterior of said silo so that said silo will fit closely within said opening, whereby said silo and said portions of said contact fingers enclosed thereby may be inserted through said opening with said conductor extending between said first and second sections of said silo and being engaged by said contact fingers.

2. A contact and guard means as claimed in claim 1, wherein:

said silo is so dimensioned that no gap in the space enclosed by the outline of said opening in said second housing exists which is of sufficient width to permit entry and contact of said conductor by any portion of a normally sized human finger.

3. A contact and guard means as claimed in claim 1, wherein:

said silo is so dimensioned that no gap in the space enclosed by the outline of said opening in said second housing exists which is of sufficient width to permit entry and contact of said conductor by any portion of a blunt-ended test probe having a diameter of not less than 0.25 inches.

4. A contact and guard means as claimed in claim 3, wherein:

said conductor to be engaged by said contact fingers is of a flat elongated form, and said extending portions of said contact fingers are adapted to engage alternately the opposite flat surfaces of said conductor.

5. A low profile, self supporting contact for engaging a conductor combined with guard means for protecting said contact and said conductor against accidental touch, comprising:

an elongated contact body of resilient conductive material;

a plurality of fingers formed integrally with said body, said fingers projecting laterally in parallel from one side of said body in spaced relationship;

each of said fingers being formed with a spring arch, the apices of said arches extending out of the plane of said body and being alternately directed oppositely away from the plane of said body;

a first insulating housing for containing said body of said contact with portions of said fingers projecting outward from an exterior surface of said first housing;

an insulating silo on said exterior surface and surrounding said portions of said fingers projecting from said surface, said silo being formed of first and second opposed shells spaced apart oppositely from said plane of said contact body to define a groove between the facing edges of said shells, said groove extending along the length and height of said silo;

said first shell being formed with corrugations spaced apart longitudinally along said first shell, the corrugations of said first shell being aligned with and covering those ones of said fingers having apices directed toward said first shell;

said second shell being formed with corrugations spaced apart longitudinally along of said second shell, the corrugations of said second shell being aligned with and covering those ones of said fingers having apices directed toward said second shell; and a second insulating housing for containing said conductor, said second housing having an opening therein aligned with said conductor, said opening having an outline of a form complimentary to and conforming with the outline of said silo, whereby said silo and said portions of said contact fingers enclosed by said first and second shells of said silo may be inserted through said opening of said second housing with said conductor extending through said groove and being engaged by said contact fingers.

6. A contact combined with guard means as claimed in claim 5, wherein:

said conductor is of a flat, ribbon-like form;

said contact fingers enclosed by said first shell of said silo being adapted to engage one flat surface of said conductor, and said contact fingers enclosed by said second shell of said silo being adapted to engage the flat surface of said conductor opposite said one flat surface thereof.

7. A contact combined with guard means as claimed in claim 6, wherein:

said portions of said contact fingers projecting externally of said first housing and said silo are so dimensioned that no gap exists in the space enclosed by said outline of said opening in said second housing exists which is of sufficient width to permit entry and contact of said conductor in said second housing by any portion of a blunt-ended test probe having a diameter of not less than 0.25 inches.

* * * * *